US008869432B1

(12) United States Patent
Koo

(10) Patent No.: US 8,869,432 B1
(45) Date of Patent: Oct. 28, 2014

(54) SHOE HAVING ELASTIC TONGUE-SECURING STRAPS

(75) Inventor: John C. S. Koo, Los Angeles, CA (US)

(73) Assignee: Dynasty Footwear, Ltd., El Segundo, CA (US)

( * ) Notice: Subject to any disclaimer, the term of this patent is extended or adjusted under 35 U.S.C. 154(b) by 728 days.

(21) Appl. No.: 13/107,180

(22) Filed: May 13, 2011

(51) Int. Cl.
*A43B 23/26* (2006.01)
*A43B 3/08* (2006.01)

(52) U.S. Cl.
CPC .. *A43B 23/26* (2013.01); *A43B 3/08* (2013.01)
USPC ..... 36/54; 36/51

(58) Field of Classification Search
CPC ..... A43B 23/26; A43B 3/08; A43C 11/20
USPC ..... 36/54, 51
See application file for complete search history.

(56) References Cited

U.S. PATENT DOCUMENTS

| | | | | |
|---|---|---|---|---|
| 249,410 | A | 11/1881 | Siegenthaler | |
| 312,675 | A | 2/1885 | Turner | |
| 355,265 | A | 12/1886 | Hayes | |
| 536,345 | A | 3/1895 | Harris | |
| 789,621 | A | 5/1905 | Mathewson et al. | |
| 970,381 | A | 9/1910 | Muller | |
| 1,028,598 | A * | 6/1912 | Papp | 36/54 |
| 1,585,049 | A | 6/1924 | Skoglund | |
| 1,759,583 | A * | 5/1930 | Martin | 36/51 |
| 2,426,524 | A | 6/1946 | Rosenbarger | |
| 2,607,131 | A | 9/1948 | Everston | |
| 3,258,862 | A | 7/1966 | Minor et al. | |
| 4,282,657 | A | 8/1981 | Antonious | |
| 4,361,969 | A | 12/1982 | Vermonet | |
| 4,451,995 | A | 6/1984 | Antonious | |
| 4,724,623 | A | 2/1988 | Silverman | |
| 5,117,567 | A | 6/1992 | Berger | |
| 5,181,331 | A | 1/1993 | Berger | |
| 5,337,493 | A * | 8/1994 | Hill | 36/54 |

(Continued)

FOREIGN PATENT DOCUMENTS

| | | | |
|---|---|---|---|
| FR | 2817449 A1 * | 6/2002 | A43B 5/00 |
| GB | 209365 | 6/1923 | |
| GB | 279327 | 4/1927 | |
| GB | 2053657 | 2/1981 | |

*Primary Examiner* — Ted Kavanaugh
(74) *Attorney, Agent, or Firm* — Joseph G. Swan, P.C.

(57) ABSTRACT

Provided are, among other things, shoes having elastic tongue-securing straps. In one representative embodiment, a shoe includes: (a) a sole; (b) an upper, extending above the sole, that includes a front section, a left side, a right side, a rear section, and a tongue that originates from the front section and extends rearwardly between the left side and the right side; (c) a left elastic strap that extends from a left side of the tongue and: (1) extends through a loop that is securely attached to the left side of the upper and has a distal end securely attached to the sole, and/or (2) has its distal end securely attached to the left side of the upper; and (d) a right elastic strap that extends from a right side of the tongue and: (1) extends through a loop that is securely attached to the right side of the upper and has a distal end securely attached to the sole, and/or (2) has its distal end securely attached to the right side of the upper, with the left elastic strap having a proximal end fixedly attached to the left side of the tongue and the right elastic strap having a proximal end fixedly attached to the right side of the tongue.

9 Claims, 6 Drawing Sheets

(56) References Cited

U.S. PATENT DOCUMENTS

| | | | | |
|---|---|---|---|---|
| 5,416,987 | A | 5/1995 | Bemis et al. | |
| 5,845,416 | A | 12/1998 | Hands | |
| 6,367,169 | B1 | 4/2002 | Barret | |
| 6,474,000 | B2 * | 11/2002 | Burt | 36/50.1 |
| 6,823,610 | B1 | 11/2004 | Ashley | |
| 6,904,706 | B2 | 6/2005 | Jones et al. | |
| 7,028,420 | B2 | 4/2006 | Tonkel | |
| 7,552,547 | B2 | 6/2009 | Calderone | |
| 8,316,561 | B2 * | 11/2012 | Jia | 36/50.1 |
| 2004/0003516 | A1 | 1/2004 | Jacobs | |
| 2004/0237348 | A1 | 12/2004 | Lacey | |
| 2005/0235525 | A1 | 10/2005 | Jacobs | |
| 2006/0168848 | A1 | 8/2006 | Leoncini | |
| 2007/0256332 | A1 | 11/2007 | Calderone | |
| 2008/0060168 | A1 | 3/2008 | Hammerslag et al. | |

* cited by examiner

FIG. 1
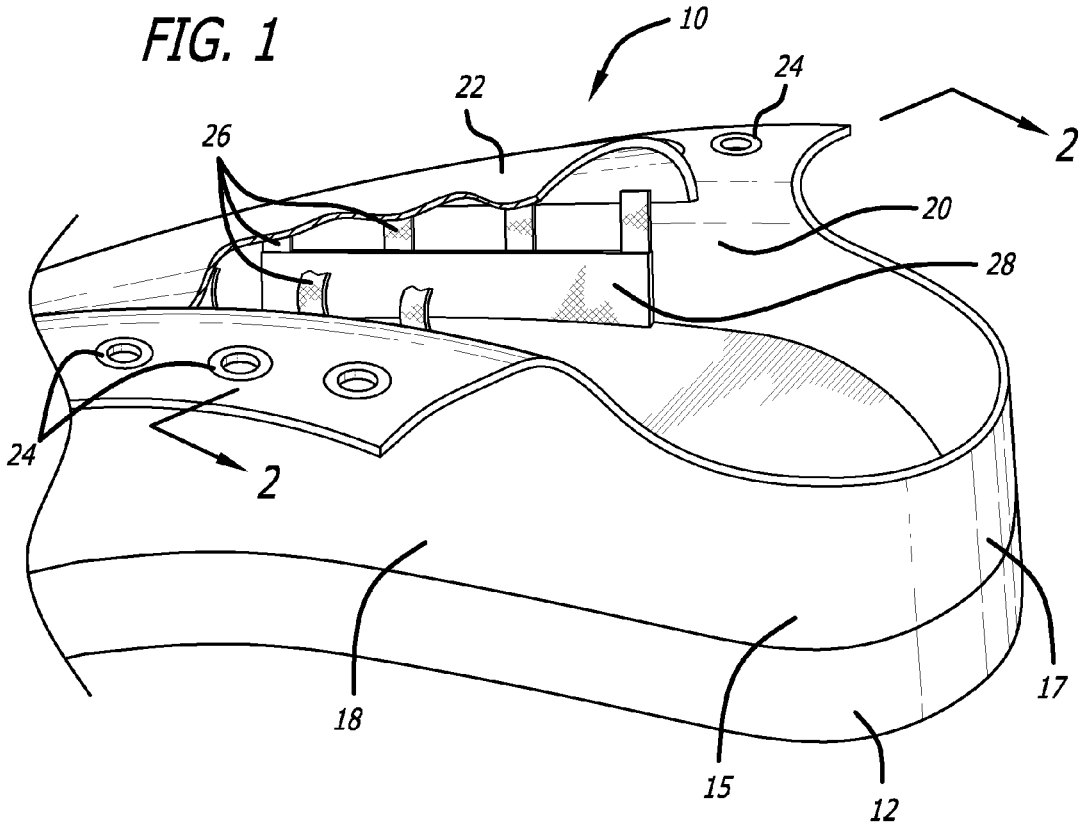
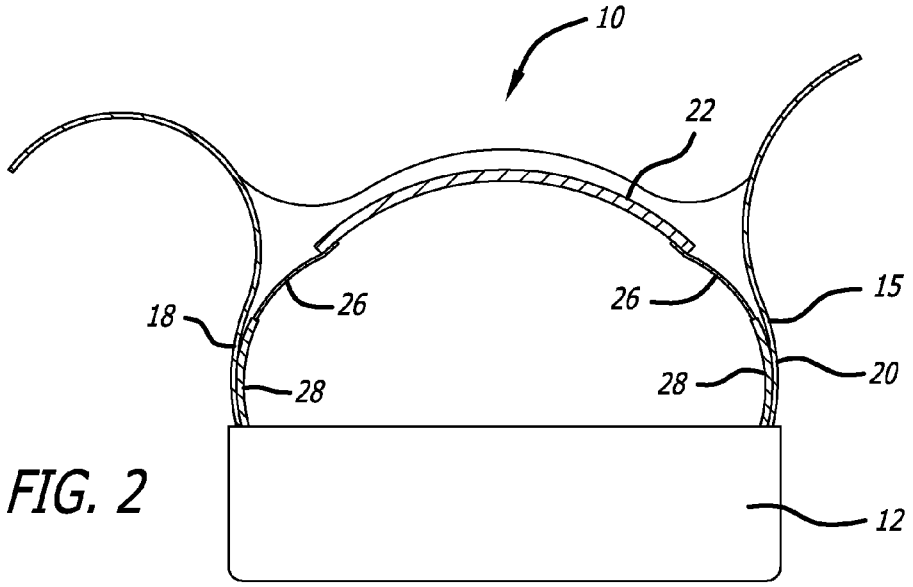
FIG. 2

FIG. 8
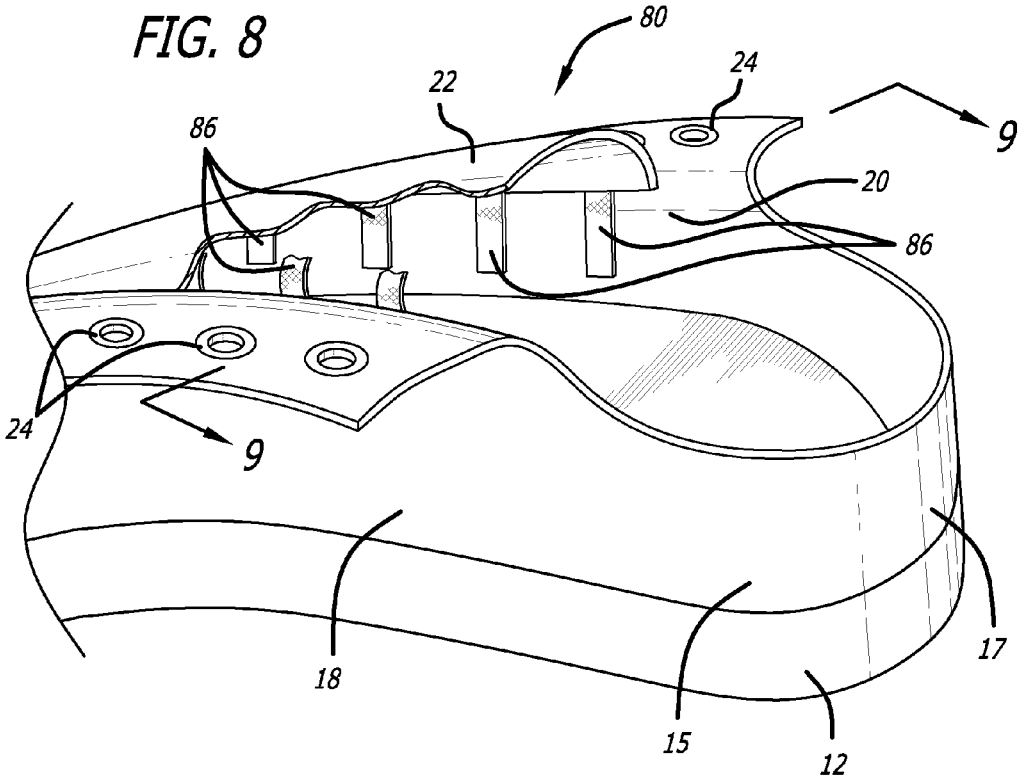
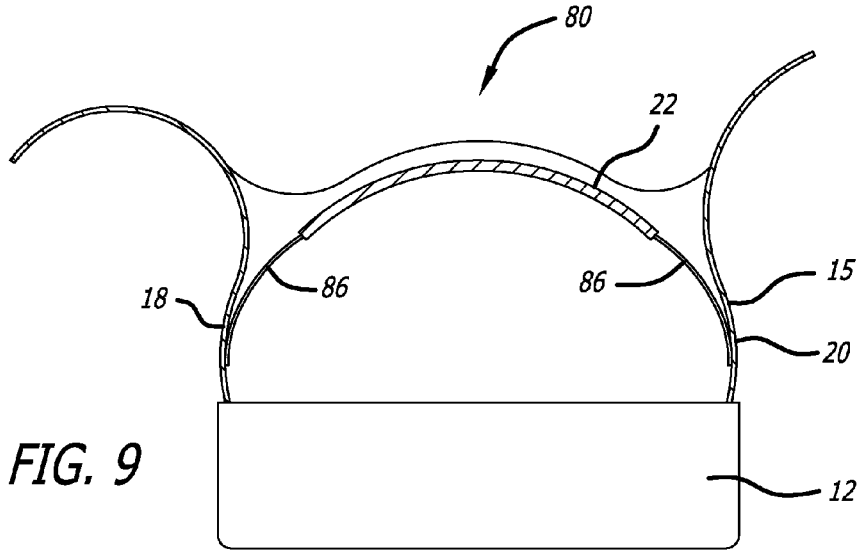
FIG. 9

SHOE HAVING ELASTIC TONGUE-SECURING STRAPS

FIELD OF THE INVENTION

The present invention pertains to shoes, such as casual shoes and other types of footwear.

BACKGROUND

A variety of different shoe styles exist. However, improvements in shoe designs remain continuously desirable. For example, certain consumers are always looking for unique combinations of aesthetics and functionality in their footwear.

SUMMARY OF THE INVENTION

The present invention addresses these needs by providing shoes in which a plurality of elastic straps secure the shoe's tongue to other portions of the shoe's structure, thereby facilitating ease-of-use, as well as enabling additional shoe styles and additional ways to wear conventional-looking shoes.

Thus, one embodiment of the invention is directed to a shoe that includes: (a) a sole; (b) an upper, extending above the sole, that includes a front section, a left side, a right side, a rear section, and a tongue that originates from the front section and extends rearwardly between the left side and the right side; (c) a left elastic strap that extends from a left side of the tongue and: (1) extends through a loop that is securely attached to the left side of the upper and has a distal end securely attached to the sole, and/or (2) has its distal end securely attached to the left side of the upper; and (d) a right elastic strap that extends from a right side of the tongue and: (1) extends through a loop that is securely attached to the right side of the upper and has a distal end securely attached to the sole, and/or (2) has its distal end securely attached to the right side of the upper, with the left elastic strap having a proximal end fixedly attached to the left side of the tongue and the right elastic strap having a proximal end fixedly attached to the right side of the tongue.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the attached drawings. However, it should be understood that the drawings merely depict certain representative and/or exemplary embodiments and features of the present invention and are not intended to limit the scope of the invention in any manner. The following is a brief description of each of the attached drawings.

FIG. 1 is a perspective view of a portion of a shoe according to a first representative embodiment of the present invention.

FIG. 2 is a sectional view of a shoe according to the first representative embodiment of the present invention, taken across the cutline shown in FIG. 1.

FIG. 8 is a perspective view of a portion of a shoe according to a fourth representative embodiment of the present invention.

FIG. 9 is a sectional view of a shoe according to the fourth representative embodiment of the present invention, taken across the cutline shown in FIG. 8.

DESCRIPTION OF THE PREFERRED EMBODIMENT(S)

Figure 3:
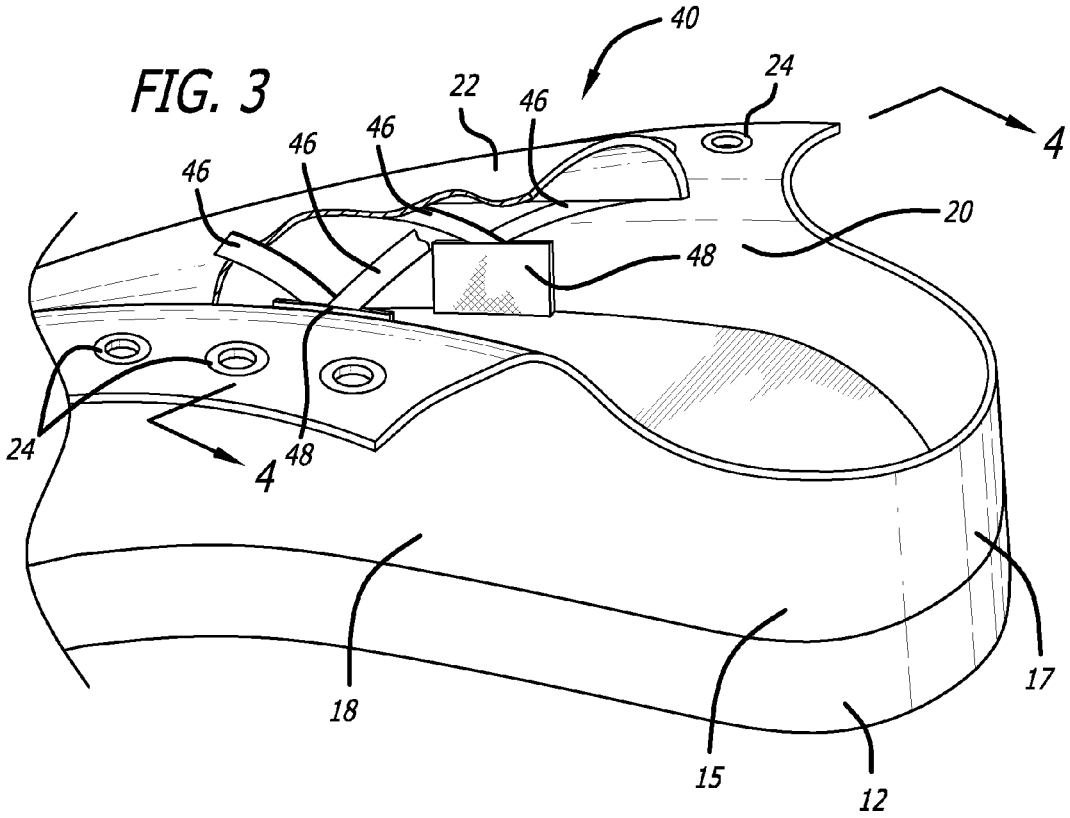
FIG. 3 is a perspective view of a portion of a shoe according to a second representative embodiment of the present invention.

In the preferred embodiments, the present invention concerns a shoe having one or more elastic straps that are securely (and, more preferably, fixedly) attached to each side of the shoe's tongue at their proximal ends and securely attached to a different portion of the shoe at their distal ends. As used herein, the expression "fixedly attached" means incapable of translational movement relative to each other at the attachment point, and the expression "securely attached" means not readily detachable.

The following paragraphs and attached drawings discuss and illustrate certain specific representative embodiments of the present invention. These embodiments generally pertain to a casual shoe, such as a low-top canvas sneaker. However, the structures of the present invention can be used in conjunction with any other kind of shoe or other item of footwear (collectively referred to as "shoes" herein). Although the attached drawings more clearly illustrate the elastic strap(s) on the right side of the shoe for each of these specifically described embodiments, in the preferred embodiments the configuration of the left-side elastic strap(s) is at least approximately a mirror image of the configuration of the right-side elastic strap(s) (or at least is similar, although reversed, as compared to the right-side configuration).

FIGS. 1 and 2 illustrate a shoe 10 according to a first representative embodiment of the present invention. As shown, shoe 10 includes a sole 12 and an upper 15. As with conventional shoes, sole 12 can be formed as a unitary piece or can include plural different layers that have been bonded, molded and/or otherwise joined together. Such different layers can include any or all of: a sock layer that makes contact with the wearer's foot, an insole immediately beneath the sock layer or forming the inner surface of the sole 12 in the event that a sock layer is not provided, an outsole that contacts the ground in ordinary use, and/or a midsole disposed between the insole and the outsole.

The upper 15 includes a rear section 17, a left side 18, a right side 20 and a front section (not shown) to which a tongue 22 is attached. As with conventional shoes, tongue 22 extends rearwardly from the front section of the shoe's upper 15, between and somewhat underneath the left side 18 and the right side 20. Each of left side 18 and right side 20 preferably also includes a plurality of eyelets 24 (e.g., comprised of plastic or metal grommets) through which shoelaces (not shown) may be threaded.

Shoe 10 also includes a plurality of relatively thin elastic straps 26 extending (preferably in an approximately parallel orientation to each other) from each side of tongue 22 (preferably at an approximately right angle to the tongue 22). In the present embodiment, the proximal end of each of such elastic straps 26 is fixedly attached to its corresponding side of the tongue, preferably along the outer one-third (⅓) or outer one-quarter (¼) of the tongue's width. More specifically, in the present embodiment the proximal end of each of the elastic straps 26 is attached to the underside of the tongue 22, e.g., through the use of stitching, adhesive material or any combination of the two. However, as discussed below and illustrated in the other drawings, in alternate embodiments, any of the elastic straps according to the present invention instead may be attached to the top side or between layers of the tongue 22. Although four elastic straps 26 are shown on each side of tongue 22 in FIG. 1, any other number instead may be used. In any event, such elastic straps 26 preferably are distributed across the length of tongue 22, or at least its rear half. In certain embodiments, use of plural elastic straps (e.g., straps 26) along each side of tongue 22 can, in certain respects, provide results that are similar to lacing.

In the present embodiment, the distal ends of the elastic straps 26 on each side of the tongue 22 are securely attached to an elongated attachment strip 28, e.g., through the use of stitching, adhesive material, one or more attachment joints (e.g., mechanical joints that permit rotation and/or pivoting), or any combination of the foregoing. In addition, e.g., elastic straps 26 may be attached to either side of attachment strip 28 or may be attached between two layers that make up attachment strip 28. Preferably, attachment strip 28 also is relatively thin, elongated and elastic (although, more preferably, it is thicker, wider and/or otherwise provides greater elastic tension than elastic straps 26), but is oriented at an approximately right angle to the elastic straps 26 (i.e., parallel to the corresponding left side 18 or right side 20 of the shoe's upper 15). The bottom edge of attachment strip 28 preferably is securely attached to the shoe sole 12, e.g., by stitching and/or gluing it to the top surface of shoe sole 12 or by inserting it between adjacent layers of the sole 12 prior to attaching them together. In addition, or instead, the top edge, bottom edge and/or midsection of attachment strip 28, or any portion thereof, may be securely attached to the corresponding left side 18 or right side 20 of the shoe's upper 15. In any event, the use of an attachment strip (such as attachment strip 28) according to the present invention often can provide a kind of free-floating structure for the elastic straps (e.g., straps 26).

Figure 4:
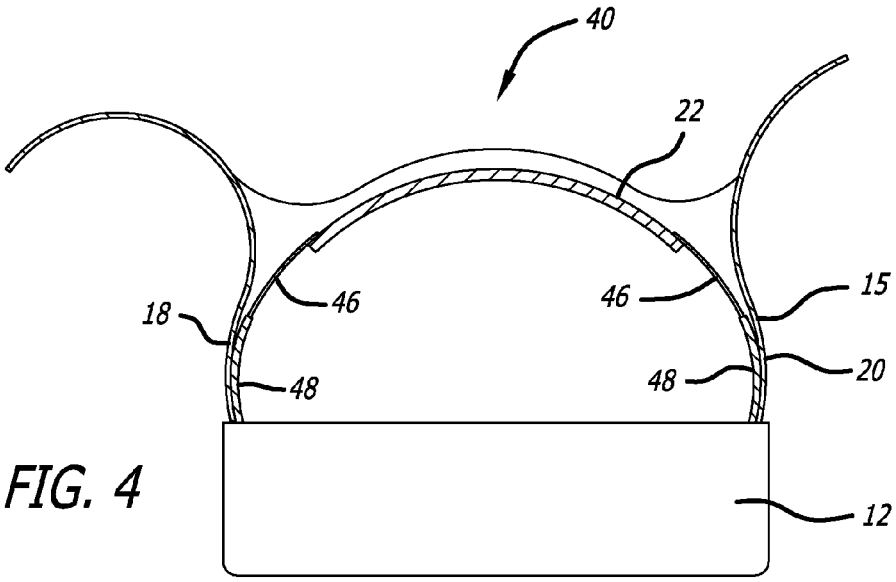
FIG. 4 is a sectional view of a shoe according to the second representative embodiment of the present invention, taken across the cutline shown in FIG. 3.

FIGS. 3 and 4 illustrate a shoe 40 according to an alternate embodiment of the present invention. Shoe 40 includes a plurality of elastic straps 46 that extend from each side of the shoe's tongue 22 and attach to an attachment strip 48. However, in the present embodiment, elastic straps 46, although extending from different points along a respective side of tongue 22, converge and attach to attachment strip 48 at a single point. Otherwise, elastic straps 46 and the considerations pertaining to them may be the same as for elastic straps 26, described above. Similarly, attachment strip 48 and the considerations pertaining to it may be the same as for attachment strip 28, described above. Although only two elastic straps 46 are shown in FIG. 3 extending from each side of tongue 22, any other number instead may be used. For embodiments that include more than two elastic straps 46 on each side of tongue 22, all of such elastic straps 46 may converge to a single point, or subsets (e.g., adjacent pairs) of the elastic straps 46 may converge to different points (e.g., with multiple attachments strips 48, one for each such point, or with a single elongated attachment strip 48). Finally, the techniques, options and considerations for attaching the elastic straps 46 and attachment strip 48 may be the same as those discussed above for elastic straps 26 and attachment strip 28, respectively. It is noted that in this particular embodiment, elastic straps 46 are illustrated in FIG. 4 as being attached to the top side of tongue 22, although they could instead be attached in any of the other ways described herein.

Figure 5:
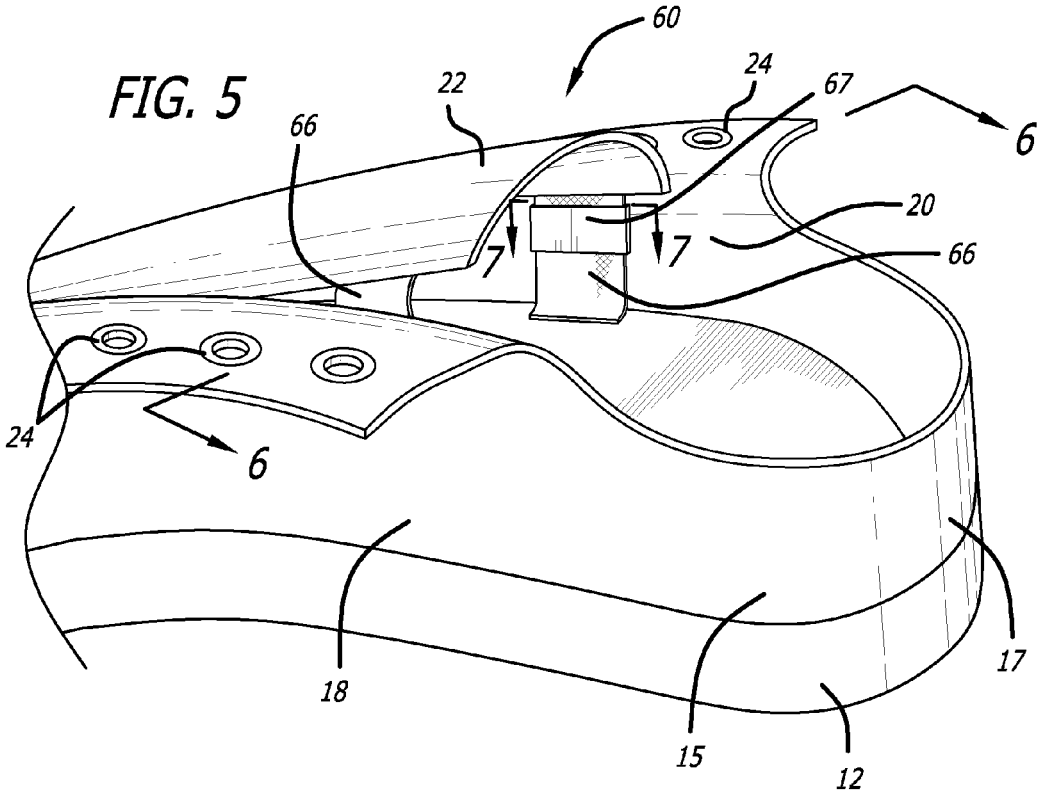
FIG. 5 is a perspective view of a portion of a shoe according to a third representative embodiment of the present invention.
Figure 6:
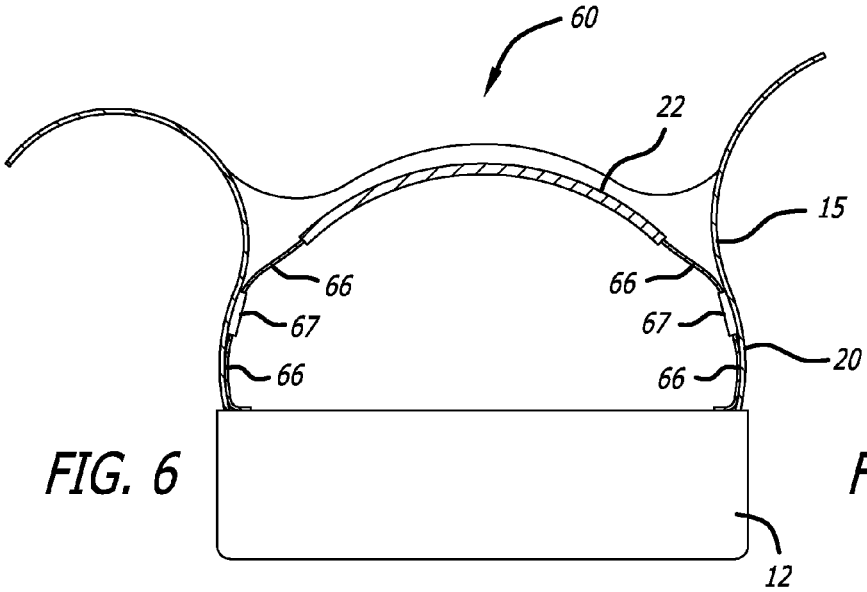
FIG. 6 is a sectional view of a shoe according to the third representative embodiment of the present invention, taken across the corresponding cutline shown in FIG. 5.
Figure 7:
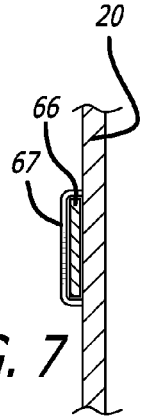
FIG. 7 is a sectional view of a portion of the right side of an upper, together with an attached loop and a strap passing through the loop, according to the third representative embodiment of the present invention, taken across the corresponding cutline shown in FIG. 5.

Another embodiment of a shoe 60 according to the present invention is illustrated in FIGS. 5-7. In shoe 60, an elastic strap 66 extends from each side of tongue 22 and through a loop 67 that itself preferably is securely attached to the corresponding left side 18 or right side 20 of the shoe's upper 15 (preferably the top portion of such left side 18 or right side 20, near the eyelets 24, just beneath the tongue 22 and/or in the upper two thirds or even in the upper one third of the distance between the shoe's sole 12 and the bottom edge of the tongue 22). The proximal end of each such elastic strap 66 preferably is fixedly attached to the corresponding side of tongue 22 (e.g., in any of the ways described above for elastic straps 26), and the distal end of each such elastic strap 66 preferably is securely attached to the shoe's sole 12 (e.g., using stitching and/or adhesive material, and/or in any of the other ways described above for attaching attachment strip 28 to shoe sole 12 or for attaching elastic straps 26 to attachment strip 28). It is noted that elastic strap 66 is illustrated in FIG. 6 as being attached to tongue 22 between adjacent layers that make up tongue 22, so the elastic strap 66 extends from the middle of tongue 22; however, any of the other attachment techniques described herein instead may be used. Although only a single elastic strap 66 and loop 67 is illustrated in the drawings on each side of tongue 22, any other number instead may be used. Similarly, when using multiple elastic straps 66 on each side of tongue 22, each such elastic strap 66 may be provided with its own loop 67, or a single elongated loop may be provided for multiple (e.g., all) elastic straps 66 on the same side of the tongue 22. In any event, in the preferred embodiments loop 67 preferably is made of a thin, smooth, flexible fabric material, so as to not interfere with the wearer's comfort, while simultaneously allowing its corresponding elastic strap(s) 66 to easily slide through it.

FIGS. 8 and 9 illustrate a further embodiment of a shoe 80 according to the present invention. In this embodiment, shoe 80 includes a plurality of elastic straps 86 extending from each side of the shoe's tongue 22. Elastic straps 86 (and the considerations pertaining to them) can be similar or identical to elastic straps 26 that were described above, but rather than having their distal ends attached to an attachment strip (as with shoe 10), the distal ends of elastic straps 86 instead preferably are securely attached to the corresponding left side 18 or right side 20 of the shoe's upper 15. Such attachment can be effected, e.g., using stitching and/or adhesive material, and the point(s) at which some or all (i.e., at least one and, more preferably, a majority, all or substantially all) of such elastic straps 86 attach to left side 18 or right side 20 of the shoe's upper 15 preferably are in the upper two thirds or, more preferably, in the upper one third of the distance between the shoe's sole 12 and the bottom edge of the tongue 22.

Figure 10:
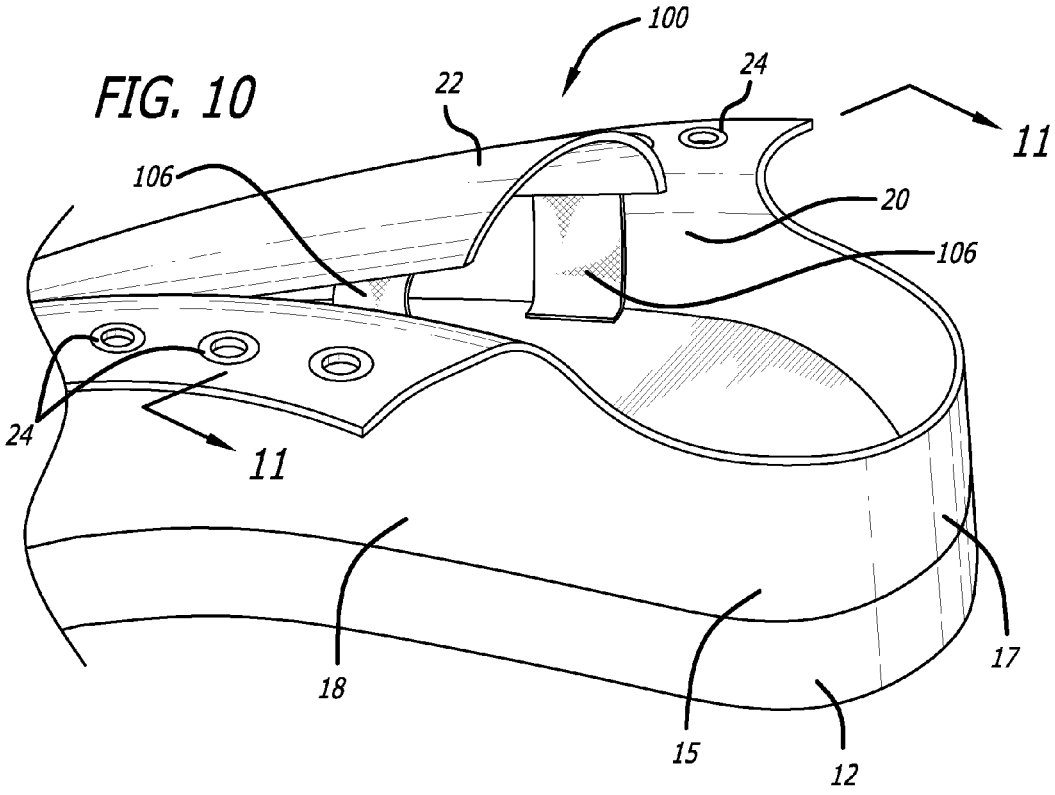
FIG. 10 is a perspective view of a portion of a shoe according to a fifth representative embodiment of the present invention.
Figure 11:
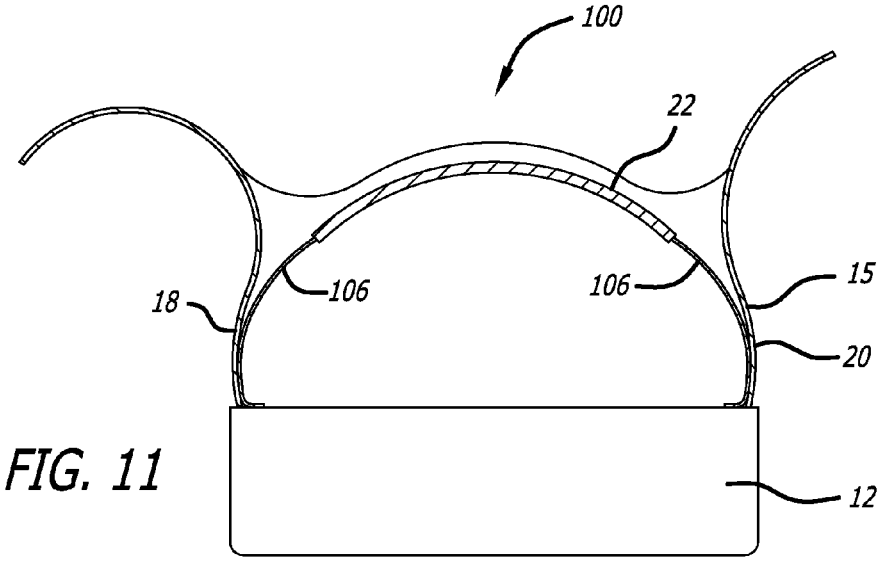
FIG. 11 is a sectional view of a shoe according to the fifth representative embodiment of the present invention, taken across the cutline shown in FIG. 3.

FIGS. 10 and 11 illustrate a still further embodiment of a shoe 100 according to the present invention. In this embodiment, on each side of the tongue 22 an elastic strap 106 preferably is fixedly attached to the tongue 22 at its proximal and preferably is securely attached to the shoe's sole 12 at its distal end. However, in alternate embodiments, the proximal and distal ends of each strap 106 may be attached in any of the other ways described herein. Also, any portion of any of the straps 106 may be attached to the corresponding left side 18 or right side 20 of the shoe's upper 15. Although only a single wide elastic strap 106 is shown in FIG. 10 on each side of tongue 22, any other number of elastic straps 106 instead can be used.

In certain embodiments discussed above, elements are described as being attached to the left side 18 or right side 20 of the shoe's upper 15. Preferably, each such attachment is to the inner surface of such left side 18 or right side 20.

In each of the embodiments described above, elastic straps are used to pull or hold a shoe's tongue in a down (or at least lower) position. In certain embodiments, the aggregate tension provided by such elastic straps is strong enough (e.g., using a small number of wider and/or higher-tension straps or a larger number of narrower and/or somewhat lower-tension straps) to hold the shoe onto the wearer's foot. As a result, it can be possible for the wearer to slide his or her foot into the shoe without tying the shoelaces, or even to wear the shoe without shoelaces at all. Not only does this approach provide for greater convenience, but it also can provide the wearer with a means to make different kinds of fashion statements, e.g., wearing shoes with the laces untied or wearing shoes that have lace-up eyelets 24 but no laces through them.

Figure 12:
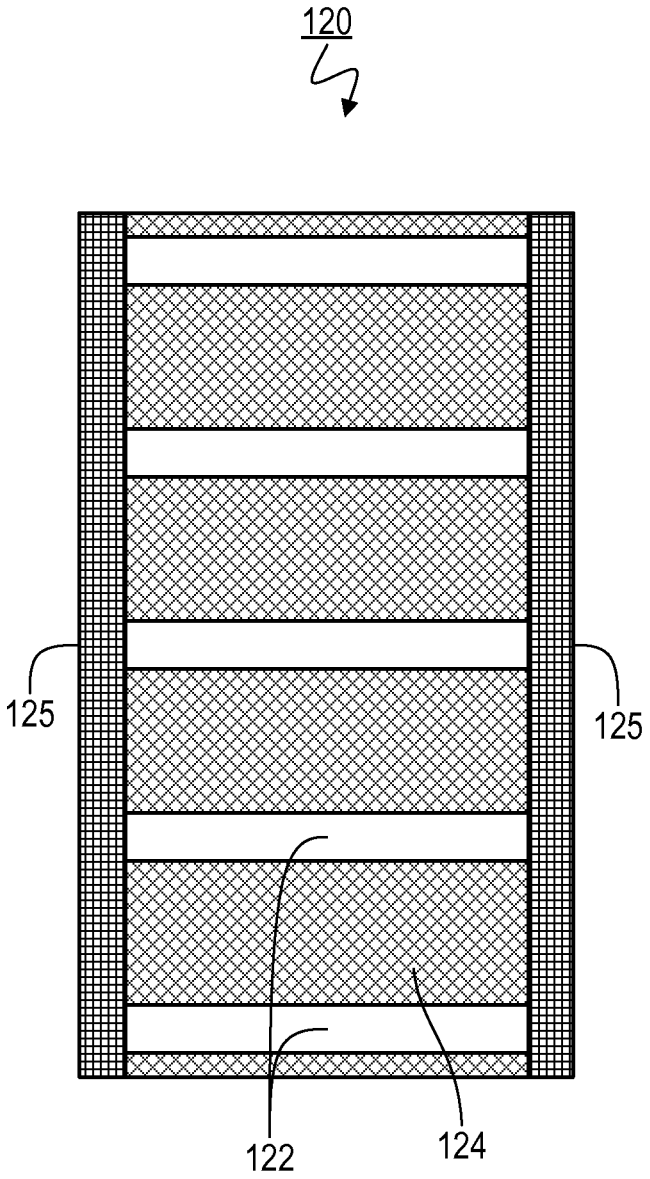
FIG. 12 is a top plan view of a piece of composite material that includes a plurality of elastic straps that are joined together using a different kind of material, e.g., to facilitate attachment of such elastic straps to different portions of a shoe.

Also, in some of the embodiments described above, plural elastic straps extend from each side of the shoe's tongue 22. In these embodiments some or all of the adjacent individual elastic straps (on one or both sides of the tongue 22) can be replaced by a single piece of material, such as a single piece of uniformly elastic material. Alternatively, such adjacent individual elastic straps can be replaced by a single piece of material 120, as illustrated in FIG. 12, having plural straps of elastic material 122 (e.g., arranged in a parallel or approximately parallel configuration) joined together with a different kind of material 124 (e.g. a mesh-like material or other material having a lower-tension elasticity). Optionally, material 120 also has stronger and/or reinforced strips 125 along its sides where the piece of material 120 is stitched or otherwise attached (e.g., along one edge 125, to the tongue 22 and, along the other edge 125, to the corresponding left side 18 or right side 20 of the shoe's upper 15 or to the shoe's sole 12). Although shown in FIG. 12 as a rectangular piece, material 120 instead can be formed in any other shape, e.g., with edges that conform to the shape of the tongue 22 on one side and conform to the shape of the junction between the sole 12 and corresponding left side 18 or right side 20 of the shoe's upper 15 on the other. In any event, using such a piece of material 120 often can facilitate assembly of the shoe when plural elastic straps are desired on each side of the tongue 22.

Additional Considerations.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A shoe comprising:

(a) a sole;

(b) an upper, extending above the sole, that includes a front section, a left side, a right side, a rear section, and a tongue that originates from the front section and extends rearwardly between the left side and the right side;

(c) a left elastic strap and a second left elastic strap that extend from a left side of the tongue, wherein distal ends of the left elastic strap and the second left elastic strap are attached to a left attachment strip that is directly attached to the sole; and (d) a right elastic strap and a second right elastic strap that extend from a right side of the tongue, wherein distal ends of the right elastic strap and the second right elastic strap are attached to a right attachment strip that is directly attached to the sole, and wherein the left elastic strap has a proximal end fixedly attached to the left side of the tongue and the right elastic strap has a proximal end fixedly attached to the right side of the tongue.

2. A shoe according to claim 1, wherein the distal ends of the left elastic strap and the second left elastic strap attach to a common point on the left attachment strip, and wherein the distal ends of the right elastic strap and the second right elastic strap attach to a common point on the right attachment strip.

3. A shoe according to claim 1, wherein both the left attachment strip and the right attachment strip are made of an elastic material.

4. A shoe according to claim 1, wherein the distal ends of the left elastic strap and the second left elastic strap also are securely attached to the left side of the upper, and wherein the distal ends of the right elastic strap and the second right elastic strap also are securely attached to the right side of the upper.

5. A shoe according to claim 1, wherein at least one of: (1) the left elastic strap and the second left elastic strap are joined together with the use of a second elastic material or (2) the right elastic strap and the second right elastic strap are joined together with the use of the second elastic material.

6. A shoe according to claim 1, wherein the left elastic strap extends through a loop that is securely attached to the left side of the upper and the right elastic strap extends through a loop that is securely attached to the right side of the upper.

7. A shoe according to claim 6, wherein both the loop that is securely attached to the left side of the upper and the loop that is securely attached to the right side of the upper are made of a thin fabric material.

8. A shoe according to claim 6, wherein the loop that is securely attached to the left side of the upper is disposed just beneath a left edge of the tongue and the loop that is securely attached to the right side of the upper is disposed just beneath a right edge of the tongue.

9. A shoe according to claim 1, wherein each of the left side of the upper and the right side of the upper further includes a plurality of lacing eyelets.

* * * * *